United States Patent [19]

Hudson

[11] Patent Number: 5,052,483

[45] Date of Patent: Oct. 1, 1991

[54] SAND CONTROL ADAPTER

[75] Inventor: Leo O. Hudson, Bakersfield, Calif.

[73] Assignee: Bestline Liner Systems, Bakersfield, Calif.

[21] Appl. No.: 609,259

[22] Filed: Nov. 5, 1990

[51] Int. Cl.[5] ..... E21B 43/10

[52] U.S. Cl. ..... 166/55; 166/181

[58] Field of Search ..... 166/55, 181, 182, 203, 166/387

[56] References Cited

U.S. PATENT DOCUMENTS 3,568,773 3/1971 Chancellor et al. ..... 166/181 X 4,796,706 1/1989 Townsend et al. ..... 166/380

*Primary Examiner*—William P. Neuder

*Attorney, Agent, or Firm*—Lyon & Lyon

[57] ABSTRACT

Apparatus for sealing a perforated liner to a well casing. A cylindrical liner having a sleeve thereabout is associated with a deforming tool which is telescoped thereon and extends to the sleeve. A portion of the sleeve is spaced from the cylindrical liner to receive the deforming tool. A pressure fluidizing solid is located within the sleeve. An impacting system for a hydraulic deforming mechanism are employed to force the deforming tool against the pressure fluidizing solid which in turn deforms the sleeve outwardly against a well casing.

11 Claims, 2 Drawing Sheets

SAND CONTROL ADAPTER

BACKGROUND OF THE INVENTION

The field of the present invention is adapters used in well casings for the setting of a sand control liner.

In wells, the control and exclusion of sand and other particulate matter so as not to be entrained into the extracted liquid is of substantial benefit. To this end, a conventional device employed for controlling such matter is a cylindrical liner having small perforations through which oil or other extracted liquid can pass. The perforations are sized to prevent the free passage of sand or other material which may exist in the formation.

To insure sufficient clearance through the irregular interior of a well casing for placement at the bottom of a well, such liners must be smaller in diameter than the casing through which they are to pass. Thus, the placement of a liner at the end of a casing further requires a closure of that clearance between the casing and the liner. To do so, the setting of the liner conventionally includes the use of a sand control adapter which couples with the liner, extends into the end of the adjacent well casing and has a seal capable of expansion outwardly against the inner wall of the casing. The seal is designed to close the clearance between the liner diameter and the inside of the well casing required for practical insertion through the well casing.

To accomplish the foregoing, sand control adapters have been developed which typically are joined to one end of a conventional liner by threads or other common mechanisms. The adapter includes a malleable sleeve concentrically fixed at one end to the outside of the cylindrical wall of the adapter. The sleeve may be expanded outwardly to engage the casing. Some form of deforming mechanism must also be provided at the bottom of the well for the deformation of the sleeve. The energy for deformation may be supplied by a hydraulic mechanism or the hammering of a tool against the sleeve by manipulation of the drill string.

Certain difficulties must be overcome in the employment of this technique. The remote location of the setting requires that the elements be positionable in the well without the risk of a premature expansion of the seal. Uniform expansion of the seal to the casing and accommodation of irregularities in that casing are also important.

Prior devices have been designed which accomplish a setting of a liner including the expansion of a malleable seal against the inner wall of the casing. One such device is illustrated in the Townsend et al. patent, U.S. Pat. No. 4,796,706, issued Jan. 10, 1989, the disclosure of which is incorporated herein by reference. In the Townsend et al. device, a cylindrical liner has an elongated tubular setting sleeve mounted to one end. The elongated tubular setting sleeve includes an annular sealing flange extending outwardly and then concentrically with the sleeve. A tubular flaring sleeve is telescoped together with the elongated tubular setting sleeve with guide slots and guide pins restricting relative axial movement. The flaring sleeve includes a beveled cylindrical end which, when forced or hammered against the sealing flange, causes the sealing flange to deform outwardly against the casing. When initially placed in the well, a nut associated with the drill string is fully threaded into the tubular flaring sleeve such that the sleeve cannot prematurely engage the annular sealing flange. Once positioned, the nut is backed off from that position allowing transmission through the nut of impacting force against the sealing flange.

SUMMARY OF THE INVENTION

The present invention is directed to an adapter for the control of sand and particulate matter in a well. The adapter may be associated with a well liner and includes a sleeve having a deformable portion which is capable of being deformed outwardly to engage and seal with a well casing. A solid which is pressure fluidizing is arranged within the deformable portion. Pressure on this solid provides a hydraulic force which can drive the deformable portion outwardly to conform to the irregular nature of the inside of the well casing.

In a further aspect of the present invention, a deforming tool having a cylindrical ram extending to cooperate with the pressure fluidizing solid is associated in telescope fashion with the body of the adapter. The deforming tool may be used to impact against or be hydraulically compressed against the pressure fluidizing solid to cause appropriate deformation of the deformable portion of the sleeve.

Accordingly, it is an object of the present invention to provide an improved sand control adapter for the setting of liners in well casings. Other and further objects and advantages will appear hereinafter.

DETAILED DESCRIPTION OF THE PREFERRED EMBODIMENTS

Figure 1:
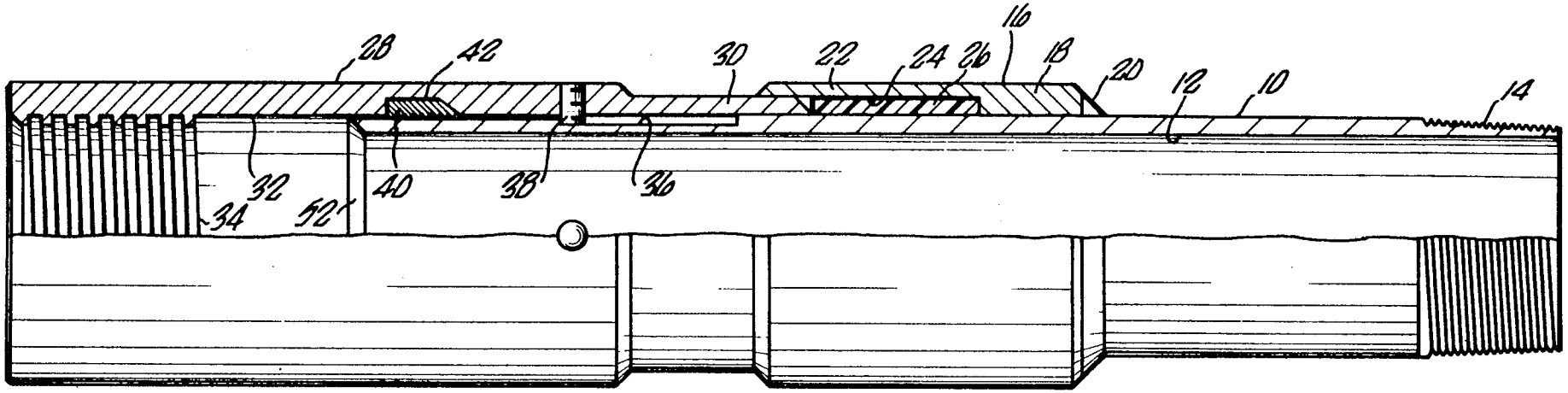
FIG. 1 is a side view of a sand control adapter of the present invention partially in cross section.

Turning in detail to the drawings, FIG. 1 illustrates a sand control apparatus prior to setting of a liner. The apparatus includes a cylindrical liner 10 including a hollow passageway 12 extending therethrough. The cylindrical liner 10 further includes a threaded portion 14 at one end. This threaded portion 14 is designed to couple with a perforated liner (not shown) of conventional design.

Located about the cylindrical liner 10 in a concentric arrangement is a sleeve 16. The sleeve 16 extends along a portion of the cylindrical liner 10 and is displaced from either end thereof. The sleeve 16 includes a first, body portion 18 which fits closely about the cylindrical liner 10. This first, body portion 18 is welded at 20 to the outside of the liner 10. Axially adjacent and integral with the first, body portion 18 is a second, deformable portion 22. This deformable portion 22 is spaced outwardly from the outer surface of the cylindrical liner 10. In this way, an annular cavity 24 is created. The annular cavity 24 is closed at one end by the first, body portion 18 and is open at the other end. The sleeve 16 is of deformable material such as 1018 carbon steel.

Located within the annular cavity 24 is a pressure fluidizing solid 26. This pressure fluidizing solid 26 may be a super polyamide. Under pressure, the solid acts more as a liquid and is substantially incompressible.

Arranged on the cylindrical liner 10 is a deforming tool 28. The deforming tool 28 is also generally cylindrical and includes a cylindrical ram 30 extending from one end thereof. The deforming tool 28 includes a hollow interior 32 which closely fits over the exterior of the cylindrical liner 10 for telescoping association. Threads 34 are located in the interior 32 at one end of the deforming tool 28 opposite from the cylindrical ram 30.

The cylindrical ram 30 closely fits in the annular cavity 24 between the outer wall of the cylindrical liner 10 and the inner wall of the deformable portion 22 of the sleeve 16. This fit forms a seal like arrangement closing the open end of the cavity 24.

Located in the wall of the cylindrical liner 10 are guide slots 36. Four such guide slots are conveniently employed. Associated with the guide slots 36 and fixed within the deforming tool 28 are guide pins 38 which cooperate with the guide slots 36. The guide slots 36 provide for a full stroke of the deforming tool 28 relative to the cylindrical liner 10 as best illustrated in both of FIGS. 1 and 2. The guide slots 36 and guide pins 38 may be as shown or reversed in their placement as may best be determined by fabrication considerations.

In addition to the guide slots 36 and guide pins 38, a wedge lock is also associated between the cylindrical lining 10 and the deforming tool 28. The wedge lock includes a wedge 40 which may be a slip ring having a roughened surface or teeth for gripping the cylindrical liner 10. The wedge lock also includes an inclined surface 42 arranged such that movement of the deforming tool 28 in a direction to separate it from the cylindrical liner 10 will result in a movement of the wedge 40 into the surface of the cylindrical liner 10 to prevent further movement. On the other hand, the wedge 40 is not so influenced by movement of the deforming tool further onto the cylindrical liner 10.

Figure 2:
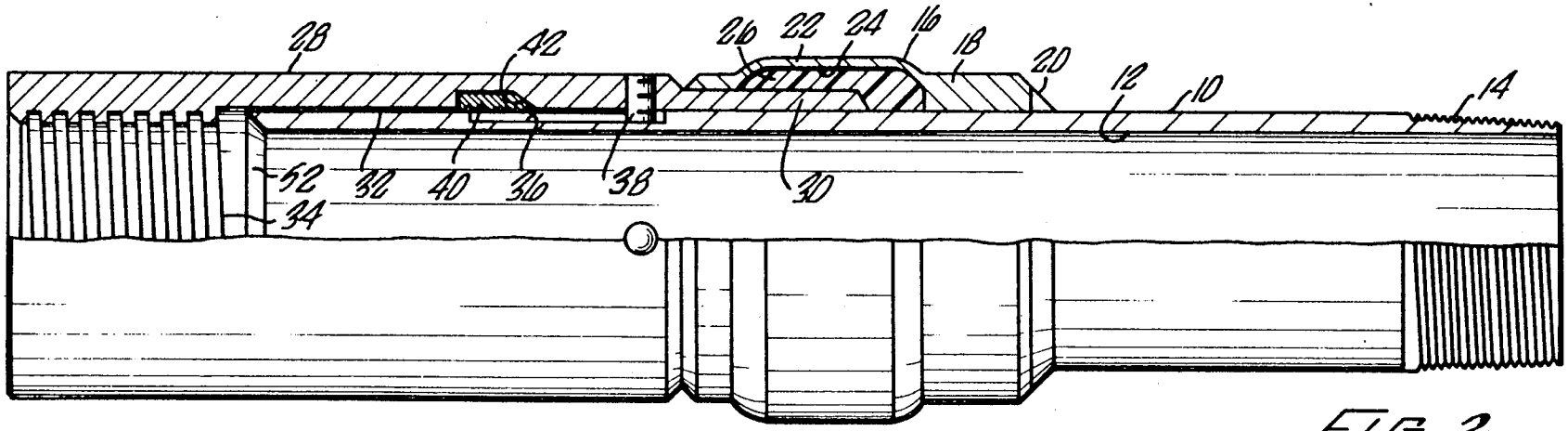
FIG. 2 is a side view of the device as seen in FIG. 1 with the adapter having been deformed for sealing in a well casing.
Figure 3:
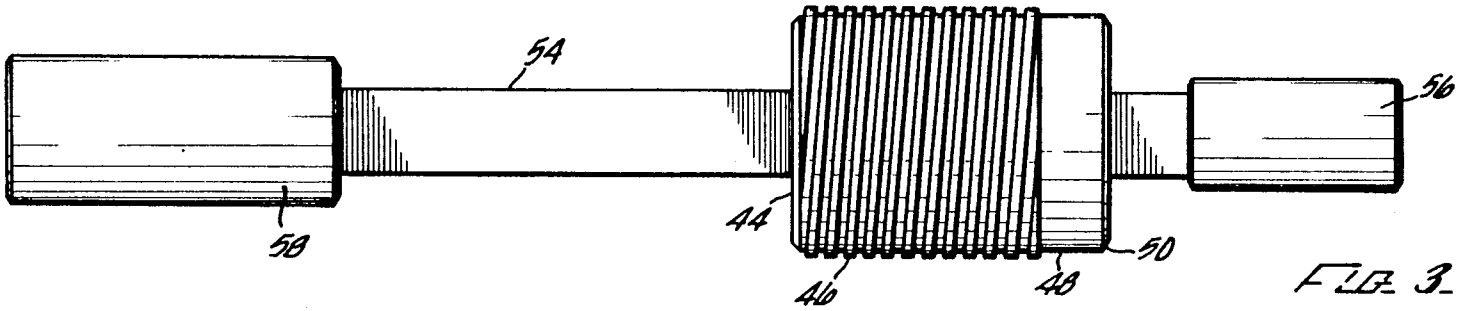
FIG. 3 is a side view of a mechanical impacting system for association with the device of FIGS. 1 and 2.

Turning to FIG. 3, an impacting system is depicted for association with the sand control apparatus of FIGS. 1 and 2. The impacting system includes an adapter nut 44 which is threaded about a portion of its outer surface. This threaded portion 46 mates with the threads 34 in the interior 32 of the deforming tool 28. For substantial impacting capability, the threaded portion 46 and the threads 34 are preferably square threads.

In addition to the threaded portion 46, the adapter nut 44 includes a cylindrical end 48 without threads. The cylindrical end 48 includes a bevel 50. This cylindrical end 48 and the bevel 50 are sized to fit against the beveled end 52 of the cylindrical liner 10 when the adapter nut 44 is fully threaded into the deforming tool 28. With the adapter nut 44 so positioned, the sand control apparatus is forced to remain in the condition as illustrated in FIG. 1. If the perforated liner or the cylindrical liner 10 impacts against the bottom of the well, the cylindrical liner 10 will be prevented from telescoping toward the deforming tool 28 because of the presence of the adapter nut 44. The bevel 50 prevents the beveled end 52 from advancing. Thus, location of the perforated liner and sand control apparatus is accomplished with the adapter nut 44 threaded such that the bevel 50 is positioned against the beveled end 52 with the cylindrical liner 10 positioned relative to the deforming tool 28 as shown in FIG. 1.

The adapter nut 44 has a square bore therethrough. The bore is designed to slidably receive a square kelly bar 54. The kelly bar 54 and adapter nut 44 include a fit such that the kelly bar may easily slide through the nut. At one end of the kelly bar, a kelly collar 56 is rigidly fixed. This kelly collar is of sufficient cross section such that it cannot fit through the square bore in the adapter nut 44. At the other end of the square kelly bar 54 is a setting tool kelly 58. This setting tool kelly 58 is also rigidly fixed on the kelly bar 54 and cannot pass through the square bore in the adapter nut 44. The setting tool kelly 58 is then associated by drill pipe or tubing threads to a drill pipe or tubing extending from the well.

Figure 4:
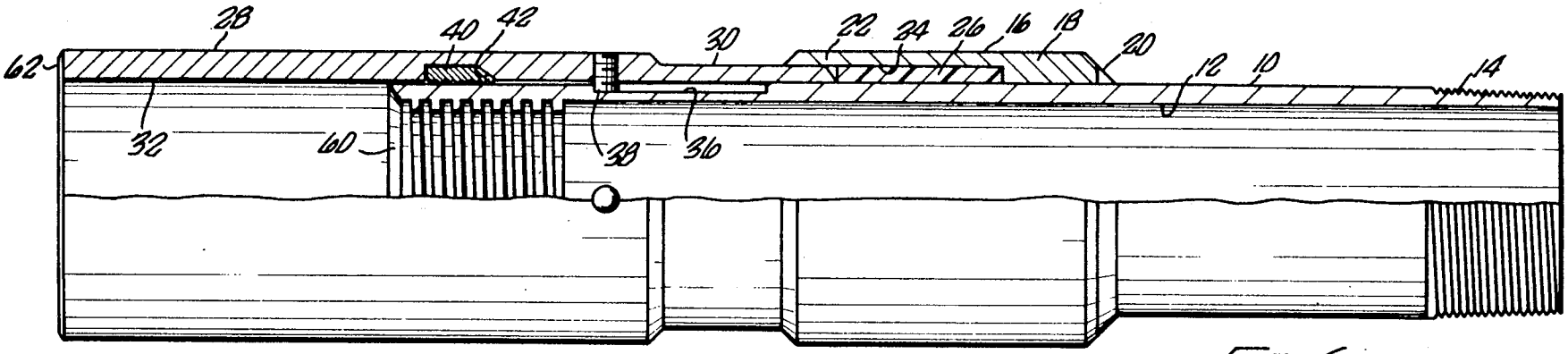
FIG. 4 is a side view illustrating an alternate embodiment of a sand control adapter for association with a hydraulic setting system.

To place a perforated liner into a well, the impacting system as shown in FIG. 4 is assembled with the sand control apparatus of FIG. 1. The adapter nut 44 is fully threaded into the threads 34 to bring the bevel 50 into contact with the beveled end 52. A perforated liner is associated with the threaded portion 14 of the cylindrical liner 10. The assembly is then run down the well to the appropriate location. The adapter nut 44 is then partially unthreaded from the deforming tool 28. This moves the bevel 50 away from the beveled end 52 such that the deforming tool 28 may move relative to the cylindrical liner 10 to the full extend of the guide slots 36. Resisting such movement is the pressure fluidizing solid 26.

To deform the sleeve 16, the square kelly bar 54 is raised such that the kelly collar 56 approaches the adapter nut 44. The drill string is then dropped such that the setting tool kelly 58 impacts against the adapter nut 44 and drives the cylindrical ram 30 into the annular cavity 24 and in turn against the pressure fluidizing solid 26. This causes the pressure fluidizing solid 26 to act much as a noncompressible liquid to drive the deformable portion 22 of the sleeve 16 outwardly against the inner wall of the well casing. Multiple impacts may be employed where necessary to properly expand the sleeve 16. The use of the pressure fluidized solid provides a relatively uniform pressure against the sleeve 16 so as to cause the sleeve to deform to match the interior of the well casing rather than to deform symmetrically in a cylindrical manner. The pressure fluidizing solid 26 may exhibit a relatively low melting temperature which would cause the solid 26 to be liquid in a steamed well or the like. Once the sand control apparatus has been positioned and deformed, the later state of the pressure fluidizing solid 26 is of no consequence.

Figure 5:
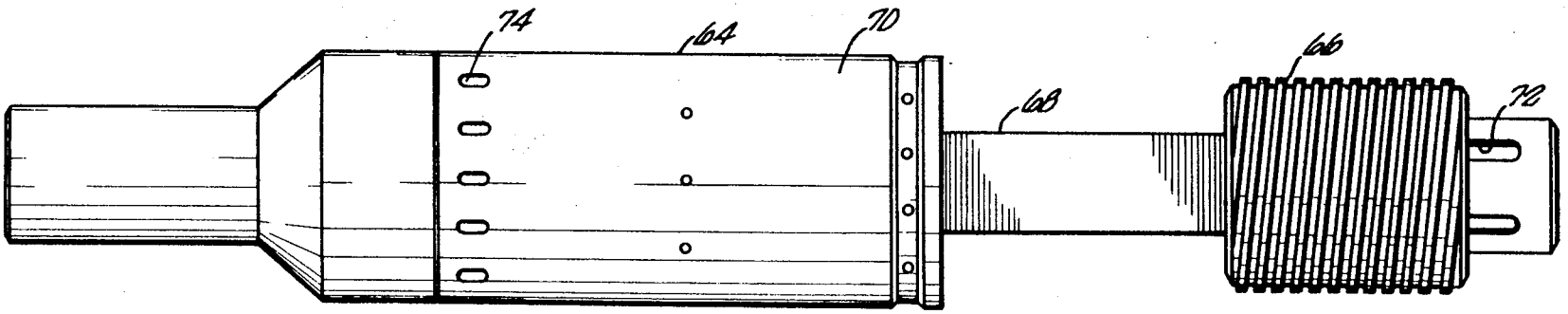
FIG. 5 is side view of a hydraulic setting system for employment with the device of FIG. 4.

FIGS. 4 and 5 illustrate a second embodiment of the present invention incorporating a hydraulic deforming mechanism. To accommodate the hydraulic deforming mechanism, the sand control apparatus as illustrated in FIG. 4 includes interior threads 60 on the cylindrical lining 10. The end 62 of the deforming tool 28 opposite from the cylindrical ram 30 forms a shoulder for receiving a hydraulic ram. FIG. 5 illustrates the hydraulic deforming mechanism as including a hydraulic ram 64 associated with an adapter nut 66. The adapter nut 66 is designed to mate with the interior threads 60 and the hydraulic ram 64 has a shoulder 68 to meet with the end 62 of the deforming tool 28. Force may be applied to the hydraulic ram to draw the adapter nut 66 toward the shoulder 68. This operates to draw the cylindrical liner 10 toward the deforming tool 28 to deform the sleeve 16 outwardly against the inner wall of the well casing.

Hydraulic rams such as rams 64 have been known. They include a piston 68 and cylinder 70 forming a variable volume chamber therebetween. The piston includes a passageway therethrough with outlet 72 at one end. Fluid within the drill pipe or tubing can flow through the passageway without generating significant differential pressure in the variable volume chamber. A pressurizing passage extends from the interior passageway of the piston to the variable volume chamber above a seat provided in the passageway. To actuate the hydraulic cylinder 64, a ball is dropped into the seat which blocks the passageway and causes the passage to direct pressurized fluid into the variable volume chamber. Expansion of this chamber subject to this pressure then forces the cylinder 70 toward the adapter 70 for setting of the sleeve 16. As the cylinder 70 slides to the top of the nut 66, the fluid is dumped through ports 74, releasing the pressure and allowing withdrawal of the tool.

Accordingly, a sand control apparatus is disclosed employing a pressure fluidizing solid for expansion of a sealing sleeve against the wall of a well casing. Either a hydraulic or mechanical system may be employed for the deformation of this sleeve. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An adapter for a well casing, comprising a cylindrical liner;

a sleeve concentrically fixed to and outwardly of said cylindrical liner, said sleeve including a first, body portion affixed to said cylindrical liner and a second, deformable portion displaced outwardly from said cylindrical liner and extending axially from said first, body portion;

a pressure fluidizing solid between said cylindrical liner and said second, deformable portion adjacent said first, body portion.

2. The adapter of claim 1 further comprising a deforming tool having a cylindrical body telescoping over said cylindrical liner and a cylindrical ram extending axially from said cylindrical body, said cylindrical ram extending in close fit between said cylindrical liner and said second, deformable portion.

3. The adapter of claim 2 wherein said cylindrical ram extends to said pressure fluidizing solid.

4. The adapter of claim 2 wherein said cylindrical liner includes guide slots and said cylindrical body includes guide pins extending into said guide slots, said guide slots extending axially of said cylindrical liner.

5. The adapter of claim 2 further comprising a wedge lock between said cylindrical liner and said cylindrical body and including a wedge and an inclined surface cooperating with said wedge to prevent separation of said deforming tool from said cylindrical liner.

6. The adapter of claim 2 wherein said cylindrical body further includes internal threads displaced from said cylindrical ram.

7. The adapter of claim 2 wherein said cylindrical liner includes internal threads.

8. The adapter of claim 2 wherein said pressure fluidizing solid is a super polyamide solid.

9. The adapter of claim 1 wherein said pressure fluidizing solid is a super polyamide solid.

10. A adapter for a well casing, comprising a cylindrical liner;

a sleeve concentrically fixed to and outwardly of said cylindrical liner, said sleeve including a first, body portion affixed to said cylindrical liner and a second, deformable portion displaced outwardly from said cylindrical liner and extending axially from said first, body portion for a first distance;

a solid between said cylindrical liner and said second, deformable portion adjacent said first, body portion, said solid extending from said first, body portion less than said first distance, said solid becoming fluid under pressure;

a deforming tool having a cylindrical body telescoping over said cylindrical liner and a cylindrical ram extending axially from said cylindrical body, said cylindrical ram extending in close fit between said cylindrical liner and said second, deformable portion.

11. The adapter of claim 10 wherein said solid is a super polyamide solid.

* * * * *